United States Patent [19]

Miller

[11] 4,045,790

[45] Aug. 30, 1977

[54] MATRIX DISCHARGE LOGIC DISPLAY SYSTEM

[75] Inventor: John W. V. Miller, Toledo, Ohio

[73] Assignee: Owens-Illinois, Inc., Toledo, Ohio

[21] Appl. No.: 606,986

[22] Filed: Aug. 22, 1975

[51] Int. Cl.[2] ..... H01J 17/48

[52] U.S. Cl. ..... 340/324 M; 315/169 TV

[58] Field of Search ..... 340/324 M, 166 EL; 315/169 R, 169 TV

[56] References Cited

U.S. PATENT DOCUMENTS

| | | | |
|---|---|---|---|
| 3,824,580 | 7/1974 | Bringol | 340/324 M |
| 3,875,472 | 4/1975 | Schermerhorn | 340/324 M |
| 3,886,404 | 5/1975 | Kurahashi et al. | 315/169 R |
| 3,908,151 | 9/1975 | Schermerhorn | 340/324 M |
| 3,925,703 | 12/1975 | Schermerhorn | 340/324 M |

*Primary Examiner*—David L. Trafton
*Attorney, Agent, or Firm*—Donald K. Wedding

[57] ABSTRACT

A gas discharge display system utilizing matrix discharge logic utilizing bulk writing of selected block or matrix area on a display panel. Panels incorporated in the invention are constructed to operate by matrix discharge logic whereby each information display site in a panel is constituted by at least a pair of positionally related cell sides, each cell side being positionally related to the other of the cell sides such that when the related side is off or has been erased, it will be written or rewritten by influence of the positional relationship to the related side, these sites being supplied with operating potentials by circuit means provided for bulk writing information to a selected block of display sites in the panel.

3 Claims, 9 Drawing Figures

10
80 x 256 PANEL
X ADDRESS CIRCUITRY 16 x 16 = 256 LINES FIG. 4
57
54
50 VOLT X ADDRESS PULSER FIG. 3
53
50 VOLT X PULL UP SUSTAINER FIG. 3
32
130 VOLT Y PULL UP SUSTAINER FIG. 5
Y ADDRESS CIRCUITRY 8 x 10 = 80 LINES FIG. 4
55
230 VOLT ADDRESS PULSER FIG. 3
32
SWITCHABLE CLAMP CIRCUIT FIG. 6
31
DECODE LOGIC
30
USER INPUT

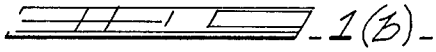
1(b)
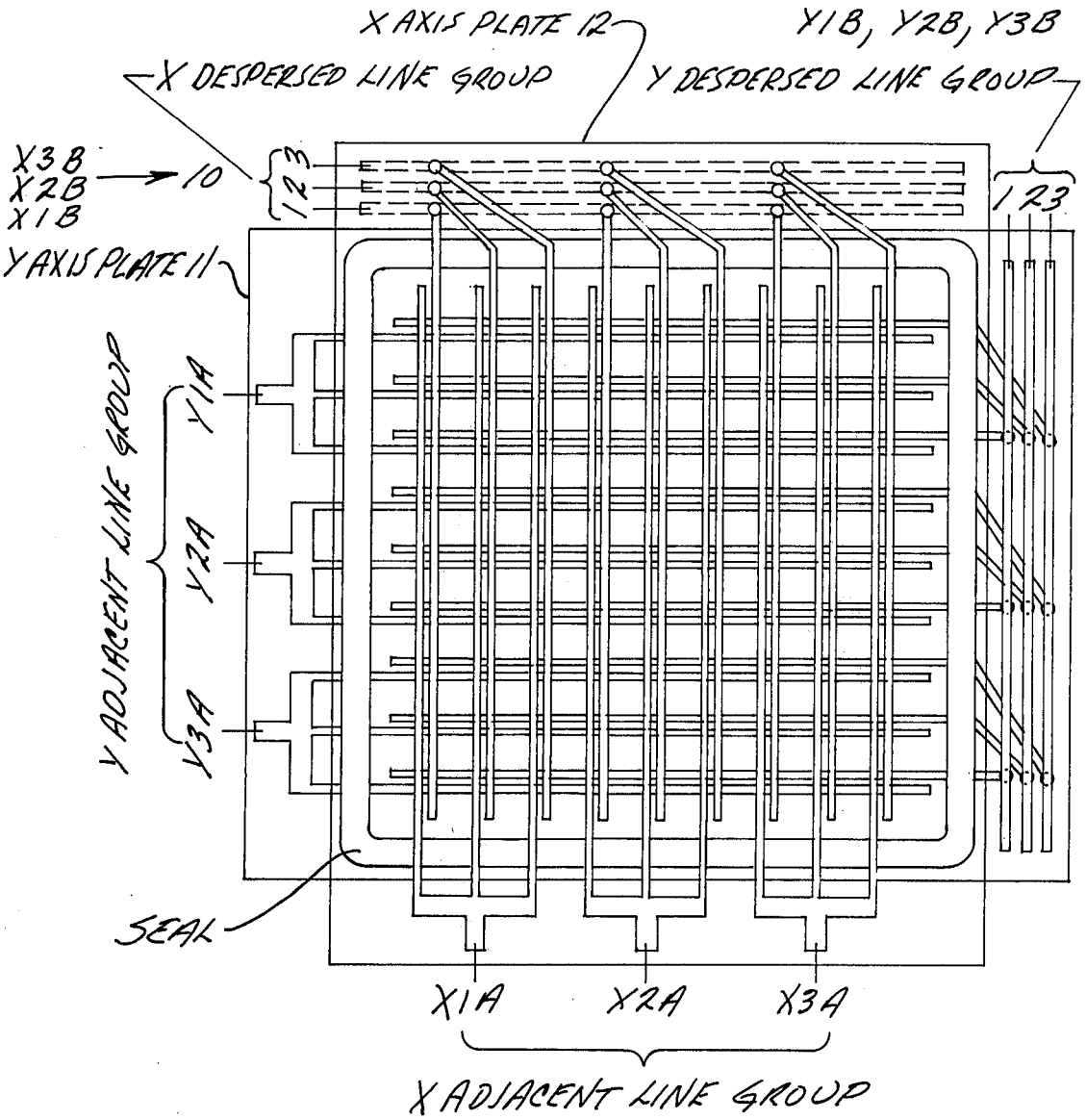

MATRIX DISCHARGE
LOGIC WAVEFORMS
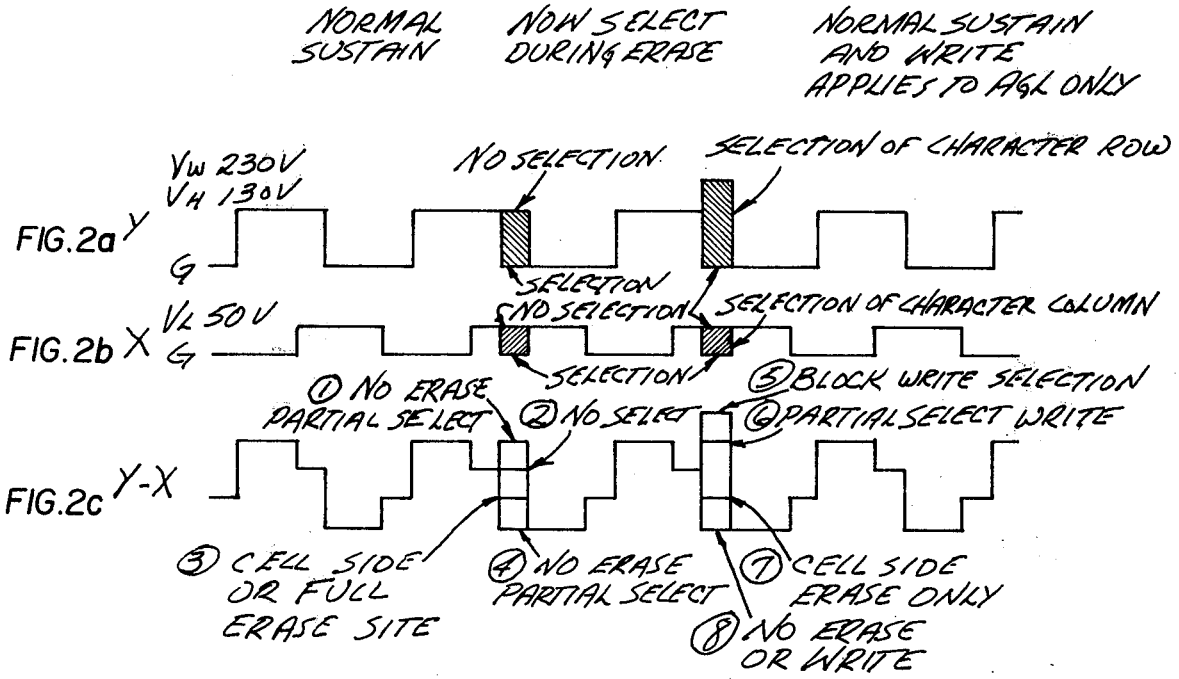
EFFECTIVE SUSTAINER VOLTAGE = $(V_H + V_L)/2$

SWITCHABLE CLAMP

MATRIX DISCHARGE LOGIC DISPLAY SYSTEM

BACKGROUND OF THE INVENTION

The present invention relates to a gas discharge display system utilizing panels constructed to operate on matrix discharge logic principles as disclosed and claimed in Schermerhorn patent application Ser. No. 372,730, now U.S. Pat. No. 3,925,703, issued Dec. 9, 1975, Schermerhorn patent application Ser. No. 372,540, abandoned, and Schermerhorn patent application Ser. No. 372,543, now U.S. Pat. No. 3,833,832, all filed June 22, 1973. As disclosed in the above-identified-patent applications, gas discharge panels constructed to operate on matrix discharge logic principles are capable of accomplishing a large amount of multiplexing internally of the panel thereby reducing the number of external connections to such panels. This is done by taking advantage of the fact that if a single electrode or conductor on a panel is replaced by two closely spaced electrodes, as disclosed in Schermerhorn U.S. Pat. No. 3,846,656 (application Ser. No. 372,541) assigned to the assignee hereof and incorporated herein by reference in its entirety, the resultant cell discharges in such electrode systems tend to merge across the electrode space so that if one side of a cell or the other is erased, the one "on" side will re-ignite the side that has been erased. Thus, since a complete cell erasure can only be accomplished by erasing both halves of a cell, a convenient multiplexing scheme can be established taking advantage of this phenomena. One way in which panels can be written for display purposes in such a system is disclosed in Schermerhorn U.S. Pat. No. 3,840,779 entitled "Circuits for Driving and Addressing Gas Discharge Panels by Inversion Techniques". According to this patent, cell inversion is used to erase the cells that are ON and then re-invert the entire panel. Thus, writing in such panels occurs by erasing the complementary state. While this approach of utilizing the discharge logic concept is effective for relatively larger displays, its expense is relatively higher for smaller and medium size displays.

Accordingly, it is an objective of the present invention to provide an improved method and apparatus for entering information to a gaseous discharge display panel constructed to operate on matrix discharge logic principles.

According to the invention, a selected block (or matrix) of information sites or information display points on the panel, such as for one character, are written in bulk, e.g. simultaneously. This method takes advantage of the groupings which occur for multiplexing and the ability of a half ON cell to ignite the OFF half. As disclosed in Schermerhorn U.S. Pat. No. 3,846,656, a typical discharge logic multiplexing scheme has groupings of adjacent lines (ALG) bussed or connected together interlaced with groupings of dispersed lines (DLG) connected by means of some type of crossover network, which may be external or internal of the panel. As thus constructed, if a write pulse is applied to one adjacent line grouping on one axis of a panel and to an adjacent line grouping on the other axis, all cells or sites at sites common to the intersection of the ALG's will be ignited, hence causing a matrix of cells to be bulk written.

The above and other objects, advantages and features of the invention will become more apparent from the following specification taken in conjunction with the accompanying drawings wherein:

DESCRIPTION OF THE PREFERRED EMBODIMENTS

Figure 1:
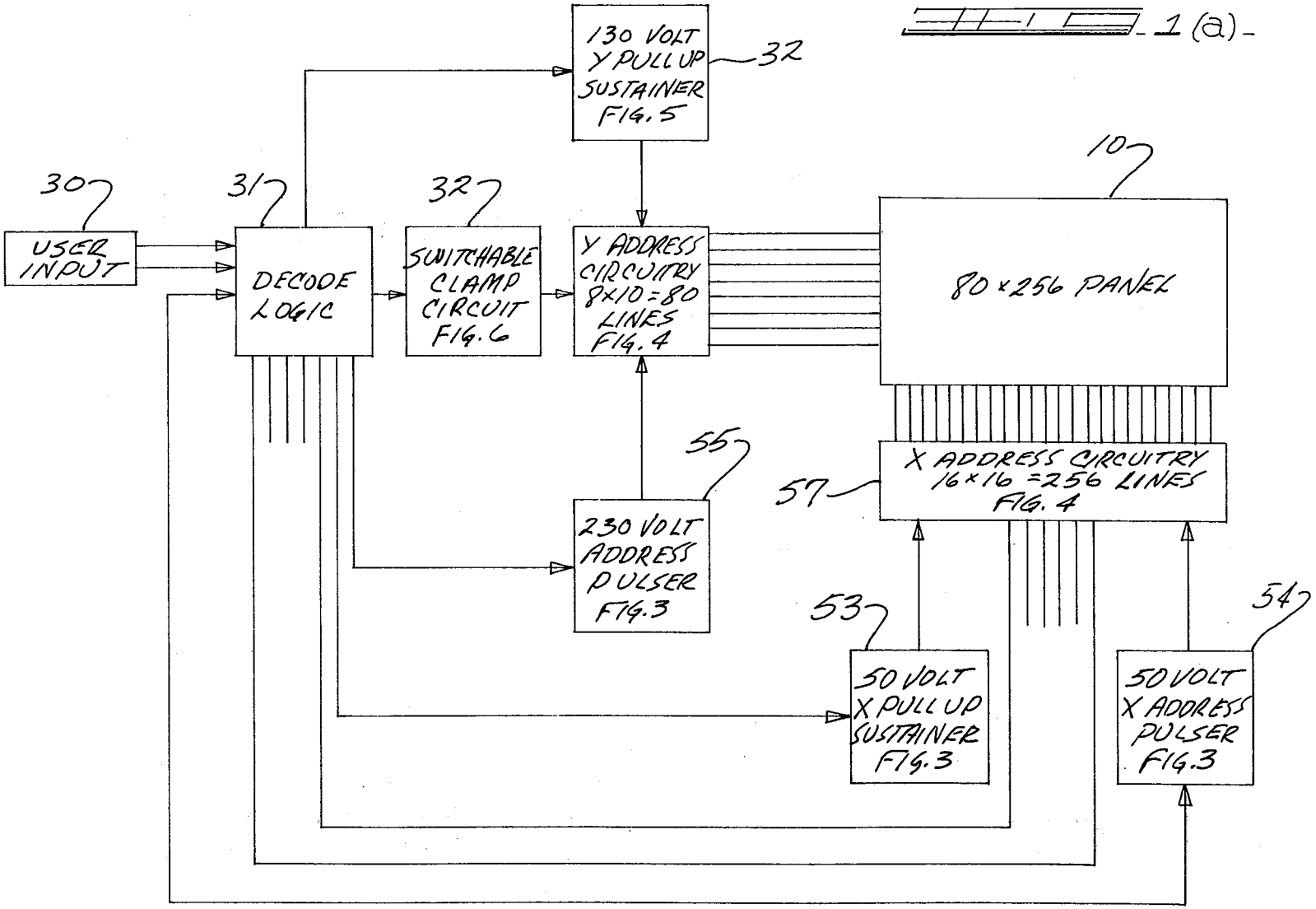
FIG. 1(a) is a block diagram of the system for supplying operating potentials to a display panel constructed to operate on matrix discharge logic principles and FIG. 1(b) is a top view of the display panel 10 of FIG. 1(a), FIGS. 2(a), 2(b), and 2(c) are a set of waveforms (not optimized) incorporating the principles of the invention.

Referring now to FIGS. 1(a) and 1(b), the gas discharge display/memory panel 10 is constructed in the manner illustrated in detail in Schermerhorn U.S. Pat. No. 3,846,656. In the present case, the electrodes are split and, as an example, can be formed by 3 mil wide electrodes spaced 3 mils apart to form the pair and that pair spaced on 24 mil centers between adjacent pairs. The crossover function can be performed internally on the panel as illustrated in said Schermerhorn U.S. Pat. No. 3,846,656 or externally using double sided printed circuit boards.

As illustrated, the electrodes are arranged in orthogonal relationship (but any other transverse relationship may be utilized provided the positional relationship for matrix discharge logic is maintained), the horizontal electrodes being designated as the Y axis and the vertical electrodes being designated as the X axis. As is conventional in the art, the electrode arrays are dielectrically isolated or insulated from a gaseous medium by means of thin dielectric charge storage surfaces. As is also conventional, the dielectric is typically 1–2 mils thick (but may be thinner) and the gas discharge gap at each intersection is under 10 mils and typically between 4 and 6 mils thick; typical gas mixtures are disclosed in Schermerhorn U.S. Pat. No. 3,840,779, such as mixtures of two noble gases, neon-argon, neon-krypton, etc.

The panel 10 in the disclosed embodiment has a pair of plates 11 and 12, plate 11 being designated the "Y axis plate" and plate 12 being designated the "X axis plate" with the Y axis plate having 80 conductor lines thereon, 9 of which are shown for each axis, and these have been split and designated as conductors $Y_{1a}$, $Y_{1b}$, $Y_{2a}$, $Y_{2b}$, . . . and in like manner, the conductors or electrodes on the X axis plate have been split and designated as X-1*a*, X-1*b*, X-2*a*, X-2*b*, . . . and in the panel illustrated there are indicated 256 panel electrode lines or conductors on the X axis. These split electrodes can be formed in many ways well known in the art (See Grier U.S. Pat. No. 3,603,836) so that only a 3 mil space, for example, exists between the electrodes forming the electrode pair and a 24 mil gap between adjacent electrode pairs. As illustrated further, the adjacent electrodes or lines of a pair designated ALG, are bussed or connected together in groupings.

The far or dispersed lines designated DLG, e.g., the *b* lines of a pair, have been connected together in groupings either externally of the panel or on the panel itself as is disclosed in Schermerhorn U.S. Pat. No. 3,846,656. It will be appreciated that different interconnection schemes may be utilized, and that the number of lines per grouping may be varied according to a particular use or application as desired. At any rate, each information display site at the crossings of the pairs of electrode lines defines four individual cells designated herein "cell sides", at each individual information display site. Moreover, these cell sides are positioned close enough to each other according to the matrix discharge logic principles as enunciated in the aforementioned Schermerhorn applications and patents that the resultant cell side discharges tend to merge across the electrode spaces at any given site so that if one side of a cell or the other is erased the one cell side will re-ignite the other cell side that has been erased at a given information display site. A complete information site erasure can only be accomplished by erasing both cell sides or halves of a cell.

According to the present invention, the adjacent electrode groupings ALG are utilized for addressing or writing purposes and the write pulses are applied to the associated line groupings on both axes of a panel so that all information display sites common to the intersection or defined by the intersection of the associated line groupings to which the write pulse has been applied will be ignited, hence causing a matrix of information display sites to be bulk written and then erasing all information display sites except those which display the desired or selected information.

FIGS. 2(a–c) illustrate the waveforms used for matrix discharge logic in accordance with the present invention. These waveforms are typically generated by the circuits to be described hereinafter. Optimization of the waveforms involves phase shifting one of the waveforms relative to the other in a manner to create a pedestal voltage to improve panel operation.

It will be noted that in these waveforms, the voltage applied to the Y axis is somewhat larger in amplitude than the voltage applied to the X axis. In connection with these waveform diagrams, repeatable events in the sustainer voltage waveform at which write, erase and normal sustain operations take place are indicated by the legends "normal sustain", "now select during erase", and "normal sustain and write applied to ALG only". These waveforms are correlated directly with the operations to be described more fully hereinafter in relation to the block diagram of FIG. 1 and the individual circuits illustrated in FIGS. 1, and 3–6. However, it will be noted that the half partial select conditions can cause no undesired erasure since, in both conditions, the full sustainer waveform (FIG. 2(c)) is maintained across the panel. By proper choice and utilization of sustainer generators, any notch problems may be eliminated or minimized.

FIG. 2(a) illustrates the voltage waveforms as applied to the Y axis electrode lines; FIG. 2(b) illustrates the voltage waveforms as applied to the X axis electrode lines (it being appreciated that the voltage applied to these axes may be reversed) and FIG. 2(c) illustrates the algebraic sum (Y-X) of the waveforms on the electrode lines and is the voltage waveform actually applied to the gas via the electrode lines and dielectric coatings. The exemplary voltage levels shown ($V_W$230V, $V_H$130V, $V_L$50V) are those developed by the circuits shown in FIGS. 3–6. Moreover, these voltages are applied to the X and Y axis electrodes at relative times indicated as set by conventional decode logic circuits 31 upon receipt of the information to be displayed from the user input 30.

With respect to the Y axis waveform voltage of FIG. 2(a) the "no selection" voltage level is applied to all electrode lines (ALG and DLG) of this axis and the "selection of character row" voltage is only applied to the ALG electrode lines.

Referring now to the voltage waveform as shown in FIG. 2(c) the resulting waveform of voltage as applied to the gas at the cell sides for erase (at all cell sides) will be seen as four separate voltage levels:

1. "no erase partial select". This voltage is the sum of $V_H$ and G or O "selection" voltage—but as seen by the gas is Y-X. Thus, in the exemplary embodiment the no-erase-partial-select level is at 130 volts.
2. "no select". This voltage is the sum of $V_H$(130V), a positive voltage, and $V_L$(50V) or approximately 80V (130V—50V).
3. "cell side or full site erase". This voltage (G) is the sum of selection level or G on the Y axis electrode line and selection or G level on the X axis electrode line for full select erase; and
4. "no erase partial select". This voltage is at a level of minus 50V and is the sum of the selection level G on the Y axis electrode lines and the $V_L$(50V) on the X axis electrode lines.

It will be seen that erase is carried out in essentially the same manner as in Schermerhorn U.S. Pat. No. 3,840,779.

As indicated earlier, the write voltages are only applied to the ALG lines. Referring to FIGS. 2(a), 2(b), and 2(c), the voltage $V_W$(at 230 volts) labeled selection-of-character-row is applied via switch clamp circuit of FIG. 6 on the ALG in the Y axis (FIG. 2(a)) whereas on the X axis (FIG. 2(b)) the selection or G voltage level is applied to the ALG electrode lines of this axis. At this point, it will be noted that the same waveform for erase and write operations has been applied on the X axis electrode lines.

The resultant write voltage levels are illustrated in FIG. 2(c) under the normal sustain and write as follows:

5. "block write selected". This voltage level is the sum of $V_W$ on the selected ALG's and the selection level (O or G) on the ALG's of the X axis.
6. "partial select write". This voltage level (approximately 130V is the sum of $V_W$ on the selected ALG's and the no-selection level on the X axis electrode lines.
7. "cell side erase only". This voltage is the same as (3) above for erase, but applies only to one cell side which re-ignites via matrix discharge logic; and
8. "no erase or write" level at which there are no change of states at any information display site corresponding to a normal sustain cycle, e.g. no addressing functions occurring.

Thus, write selection occurs across the cell sides that have the X axis at low potential and the Y axis at the maximum potential, and writing is inhibited elsewhere in the panel. Since the erase waveform appears across non-selected Y line groupings, and selected X lines, partial erasure of some of the cell sides of ON information display sites can occur but the entire information display site will re-ignite because of the coupling due to the positional relationship of the ON cell side of such a site. Thus, there are no erroneous erasures since one side of all cells is continuously sustained. The X axis will have to provide about 230 volts and the Y axis about 60 volts. Addressing is accomplished by pulling or not pulling to ground.

Referring now to the block diagram of FIG. 1(a), all of the individual components illustrated therein for carrying out the functions described hereinabove, are knwon in the art and need only be generally described herein. Referring firstly to the user input block 30, these are constituted typically by a computer, typewriter, or other data source supplying encoded digital signals to the information display sites in panel 10. The logic circuit components 31 are conventional and are provided for the purpose of decoding this information with respect to the information display sites in the panel, this logic circuit functions to provide the control signals to the Y pullup sustainer, the 230 volt address pulser and the switchable clamp circuit and also to provide the information to the X address circuitry. In short, the information inputted in user input block 30 to the decode logic system 31 controls the write-erase times of occurrence illustrated in the waveform diagram of FIGS. 2(a–c) with respect to each information display site in the panel and in the present case, the circuits are activated for blocks of information display sites in the manner to be described more fully hereinafter.

Figure 5:
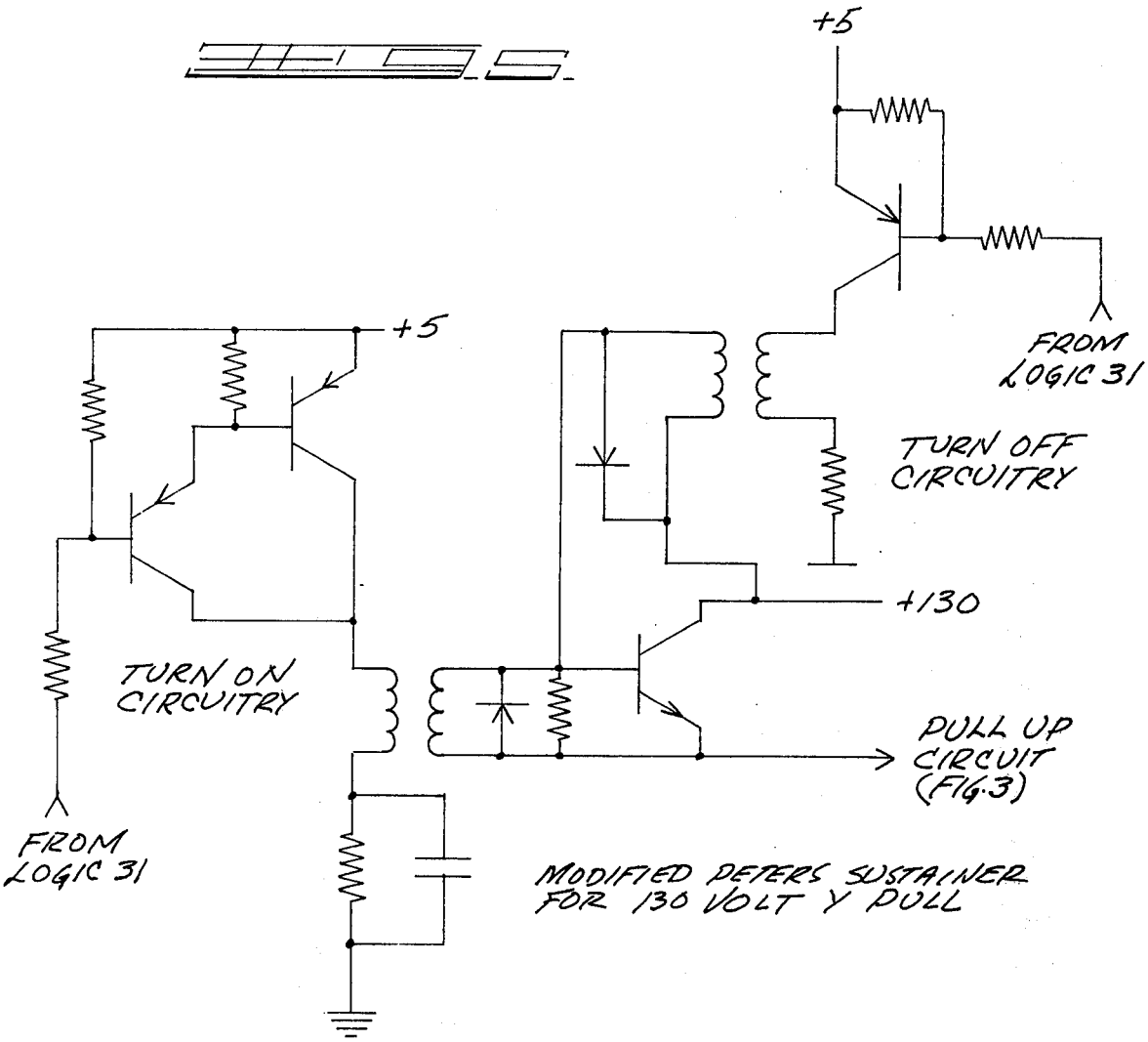
FIG. 5 illustrates a preferred form of Y axis pullup sustainer.

The different outputs from the decoding and logic circuit 31 are applied to the 130 volt Y pullup sustainer 32 which is illustrated in FIG. 5. This circuit is of the type disclosed in Peters U.S. Pat. Nos. 3,846,646; 3,777,182, which relate to circuits for driving a waveform developed by a pullup, and pulldown switches to a common sustainer voltage bus. In this case, the turn on circuit receives voltage pulses from the logic circuit 31. This circuit is not unique in connection with the present application and its operation is conventional insofar as the present application is concerned. It should be noted, however, that the circuit can be simplified when driving a relatively smaller panel.

Figure 3:
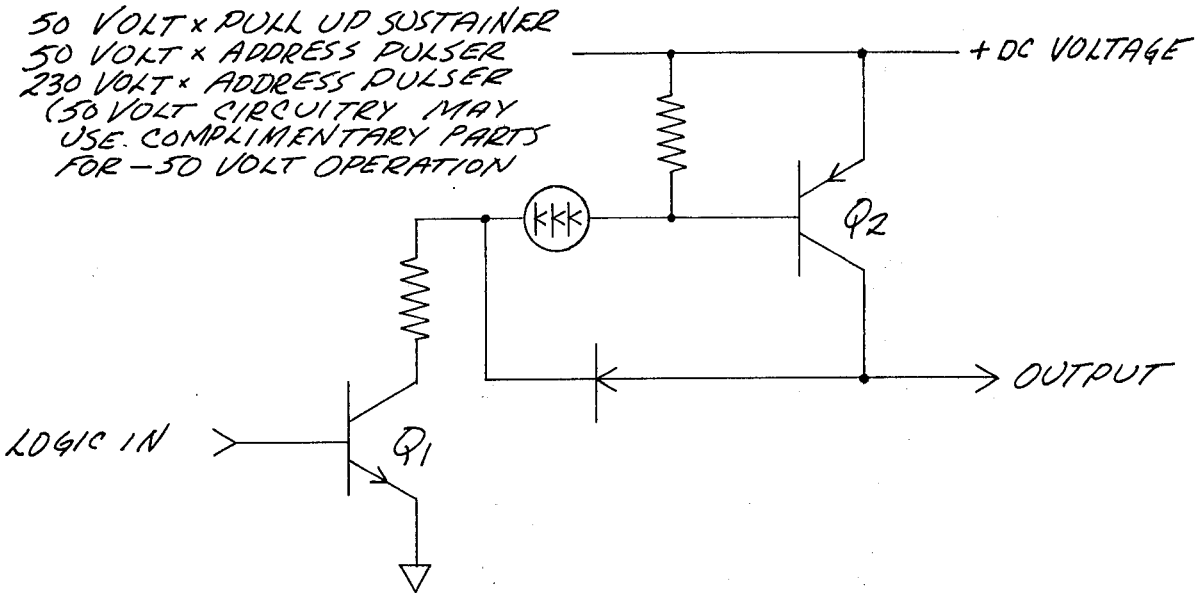
FIG. 3 shows a preferred form of a circuit for the low voltage pullup sustainer on the X axis.
Figure 4:
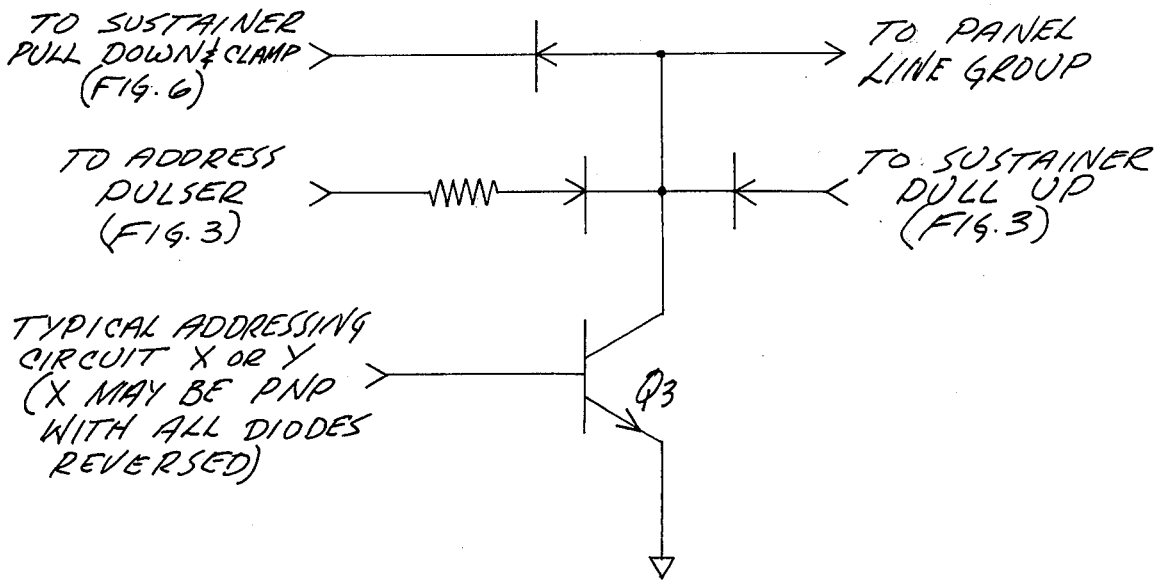
FIG. 4 is a typical addressing circuit incorporated in the X and Y address circuitry of FIG. 1.
Figure 6:
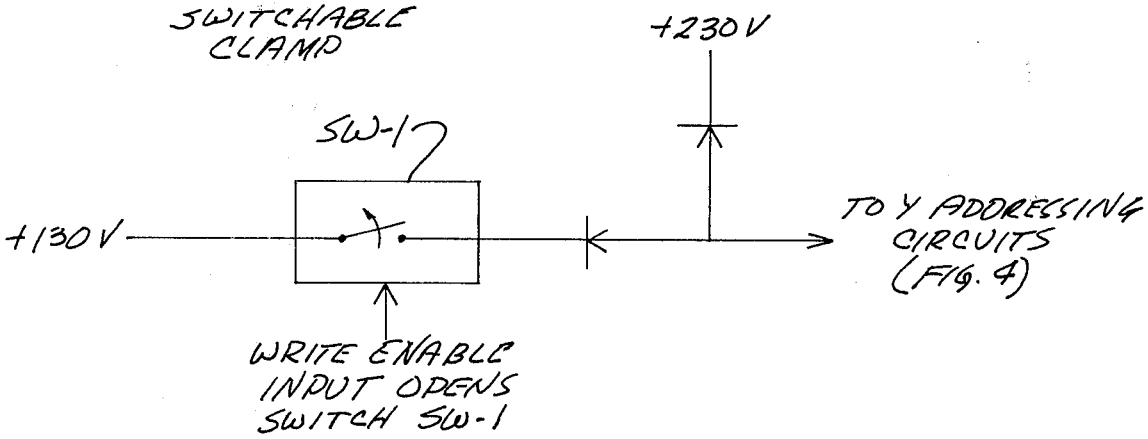
FIG. 6 illustrates in equivalent circuit form a switchable clamp circuit which may be used for the adjacent line groupings on the Y axis.

The two 50 volt pullup sustainers 53 and the 50 volt address pulser 54 and the 230 volt address pulser 55 (for the Y address circuitry) is illustrated generally by the circuit shown in FIG. 3. This circuit is basically a complementary pair with output stage Baker clamped (see Wojcik U.S. Pat. No. 3,786,485) for higher switching speeds. An input logic voltage pulse on the base of transistor Q1 supplies a turn on pulse to Baker clamped transistor Q2. A typical addressing circuit for the X address circuitry 56 and the Y address circuitry 57 is shown in FIG. 4. The circuit shown in FIG. 4 is shown for a Y addressing system but for the X axis addressing the transistor may be PNP with all the diodes reversed. These are the most numerous circuits in the system, but they are not complex and are relatively inexpensive. A turn off pulse is supplied to transistor Q3 for enabling this address circuit. FIG. 6 illustrates a switchable clamp circuit, switch SW1, opened by a write enable pulse, controls application of either the 230V or 130V D.C. level to the Y axis addressing circuits of FIG. 4. It will be appreciated that these circuits are merely exemplary and that those skilled in the art may devise others for performing the same or equivalent functions without departing from the spirit and scope of the invention.

What I claim is:

1. A gas discharge display panel system comprising in combination a gas discharge panel having an array of information display sites each information display site is a crosspoint of crossed electrode arrays, and each electrode in each of said arrays is split and multiplexable to define adjacent electrode line groupings and dispersed electrode line groupings each constructed to operate by matrix discharge logic whereby each information display site in said panel is constituted by at least a pair of positionally related cell sides, each cell side being positionally related to the other of said cell sides such that if at a given information display site one of the said related sides thereat has been erased, the erased side will be rewritten by influence of said positional relationship to a related cell side, means for bulk writing information to a selected block of display sites in said panel, including means for supplying periodic sustainer potentials to said information display sites, said means for bulk writing further includes means connecting adjacent electrode lines of consecutive pairs to each other in groups and means connecting dispersed electrode lines of each pair in groups, said means for bulk writing includes address write and erase voltage pulse circuit means, and said address write voltage pulse circuit means is connected to supply address write voltage pulses to selected ones of said adjacent line groupings and address erase voltage pulses are selectively applied to all said conductor groupings.

2. The invention defined in claim 1 wherein said address write and erase voltage pulse circuit means have a switch circuit selectively establishing the write and erase voltage levels, respectively, applied to cell sides of selected groups of said information display sites.

3. The invention defined in claim 1 wherein the said periodic sustainer potential is constituted by the algebraic sum of potentials applied to opposite sides of the gas at said information display sites via said electrode arrays, and the voltage level in one of said arrays is at a higher level than the voltage level on the other of said arrays.

* * * * *